United States Patent [19]

Füssl et al.

[11] Patent Number: 4,482,280

[45] Date of Patent: Nov. 13, 1984

[54] FEEDING APPARATUS FOR UNIFLOW REGENERATIVE SHAFT FURNACES FOR CALCINING LIMESTONE AND SIMILAR MINERAL MATERIALS

[75] Inventors: Erwin Füssl, Zurich, Switzerland; Horst Waldert, Kaarst, Fed. Rep. of Germany

[73] Assignee: Maerz Ofenbau AG, Zurich, Switzerland

[21] Appl. No.: 341,476

[22] Filed: Jan. 21, 1982

[30] Foreign Application Priority Data

Apr. 23, 1981 [CH] Switzerland ..... 2667/81

[51] Int. Cl.[3] ..... F27B 1/20

[52] U.S. Cl. ..... 414/21; 414/167; 414/171; 414/199; 414/204

[58] Field of Search ..... 414/160, 167, 169–171, 414/199–206, 162, 163, 266–269, 272, 21; 266/176, 184; 432/96, 100

[56] References Cited

U.S. PATENT DOCUMENTS

| | | | |
|---|---|---|---|
| 752,688 | 2/1904 | Kramer | 414/272 |
| 955,885 | 4/1910 | Kennedy | 414/203 |
| 3,951,750 | 4/1976 | Drebes | 414/163 X |

*Primary Examiner*—Robert G. Sheridan

*Attorney, Agent, or Firm*—Toren, McGeady and Stanger

[57] ABSTRACT

Feed apparatus for a uniflow regenerative shaft furnace for the calcining of limestone and similar raw materials is formed with a feed container installed above each of the shafts of the furnace, each of the feed containers being arranged concentrically with the shaft axis of the respective shaft over which it is installed and constructed to be maintained in rotation during filling thereof of the material to be calcined.

1 Claim, 2 Drawing Figures

FEEDING APPARATUS FOR UNIFLOW REGENERATIVE SHAFT FURNACES FOR CALCINING LIMESTONE AND SIMILAR MINERAL MATERIALS

The present invention relates generally to uniflow regenerative shaft furnaces for the calcining of limestone and similar raw materials and more particularly to feeding apparatus for providing such furnaces with the basic raw material to be calcined and for delivering such raw material into the shafts of the furnace.

Calcining of limestone and similar raw materials utilizing the uniflow regenerative process is generally well-known (see Austrian Pat. No. 211 214) and such processes have widespread use in many countries in recent years. In this calcining process, at least two shafts are generally required in the furnace which, after a certain calcining cycle of approximately ten to fifteen minutes, are reversed insofar as their mode of operation is concerned. The shafts of such furnaces usually serve alternately as a calcining shaft or as a counterflow shaft for the exhaust gases. For each cycle of combustion, the material which is to be calcined, e.g., limestone, is delivered to the combustion shaft of the furnace in a quantity of a certain predetermined weight corresponding to the desired production of burned product desired for this period of time. Because the raw material must be delivered to the furnace in predetermined, measured quantities, the feeding equipment must be adapted to the calcining cycles involved.

In the prior art, various designs of feeding apparatus for uniflow regenerative shaft furnaces are known. With a furnace having two or more shafts, it is known to transport the material which is to be calcined, for example the limestone, to the furnace by means of a conveyor belt or lift hoist. The limestone required in accordance with the combustion cycle of the furnace may be brought by a conveyor belt or lift mechanism directly into a weighing hopper with two locks wherein the hopper serves as a central bin between the shafts. Usually, the limestone is conveyed over the furnace and it arrives in one of the shafts of the furnace after one of two bin locks has been opened over the chutes, one of which is assigned to each shaft. Since the shafts are under pressure during the calcining operation, it is additionally necessary to provide hinged covers or shutter lids on the weighing hoppers. Additionally, lids which will enable tight closure are also built into the chutes. This arrangement has the disadvantage that the chutes are very long and this occurs especially in large furnaces having a large shaft cross section. Thus, it is possible that the bulk of the mineral raw material to be calcined will become less uniformly blended as it is passed through the chutes. This is especially true when the raw material is composed of a wide range in the size of the particles thereof, for example, size ratios of 1:2 or even 1:4. When such a decrease in the uniformity of the blending of the raw material occurs, the larger pieces of material tend to fall outwardly in the shaft and the smaller pieces tend to fall inwardly thereof. When such loss of uniformity in blending occurs it becomes more difficult to product a uniformly calcined product.

Conditions regarding the tendency toward loss of uniformity in the blending of the raw material tend to occur in other prior art devices wherein the material to be calcined is not weighed over the furnace but instead beneath the furnace or perhaps on the plant floor and is transported through shafts by means of a skip lift into a central bin of the system. During its travel through the chutes into the furnace shafts, there again occurs in such systems a disadvantageous loss of blending uniformity in the material to be calcined.

In a third known design which is used in large uniflow regenerative lime shaft furnaces, there is utilized a turning bucket with a lift. The total amount of limestone needed for the combustion cycle, which usually requires at least eight tons in the case of large furnaces, is weighted into the turning bucket at a level approximately on the plant floor. Although the rotating action of the bucket does achieve some uniformity in the distribution of the particles of varying size in the turning bucket, there is nevertheless the disadvantage that a heavy bucket with an overall weight of about 16 tons, including the batch of limestone, must be lifted over the furnace shafts and then conveyed over the shafts. During each calcining cycle, that is within periods of ten to fifteen minutes, the turning bucket must acquire a full load and remain until the end of the calcining cycle hanging with its full weight of stone in the ready position above the shaft which is to be fed after the completion of a cycle in that shaft. Only then, and after opening of the shaft lock occurs, is the bucket set upon the shaft in order to evacuate the stone. Consequently, disadvantages in this type of design arise in that great weight of the turning bucket with the limestone must be lifted and conveyed over long distances during comparatively short periods of time.

In view of the foregoing, the present invention is directed toward improvements in the design of feeding apparatus of the type described wherein the disadvantages of prior art feeding equipment may be overcome. On the one hand, the present invention seeks to achieve feeding of the raw material without causing a loss in the uniformity of the blending of the material while on the other hand the invention avoids the necessity for movement of equipment and material involving great or substantial weight.

SUMMARY OF THE INVENTION

Briefly, the present invention may be described as feeding apparatus for a uniflow regenerative shaft furnace for the calcining of limestone and similar raw material including feed container means for delivery to the shafts of the furnace of raw material to be calcined, wherein the improvement involves that the feed container means comprise a feed container installed above each of the shafts of the furnace, with each of the feed containers being arranged concentrically with the shaft axis of the respective shaft over which it is installed. Furthermore, the feed containers are constructed so as to be rotatable while filling thereof of the raw material is effected and also to be vertically moveable for filling and feeding operation.

Thus, the objectives of the invention are achieved in that the feed container or feed box is installed above each shaft concentrically with the axis of the furnace shaft. By disposition of the feed box or container immediately over the shaft, the effect which is achieved is that of a uniform distribution of the differently sized particles of material to be calcined. By operation of the invention, loss of uniformity of blending of the material particles is reliably avoided by holding the raw material charge in a position ready for feeding directly over the furnace shaft. Furthermore, it is possible with the invention to utilize feed apparatus which is capable of feeding several furnaces.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described preferred embodiments of the invention.

DETAILED DESCRIPTION OF THE PREFERRED EMBODIMENTS

Figure 1:
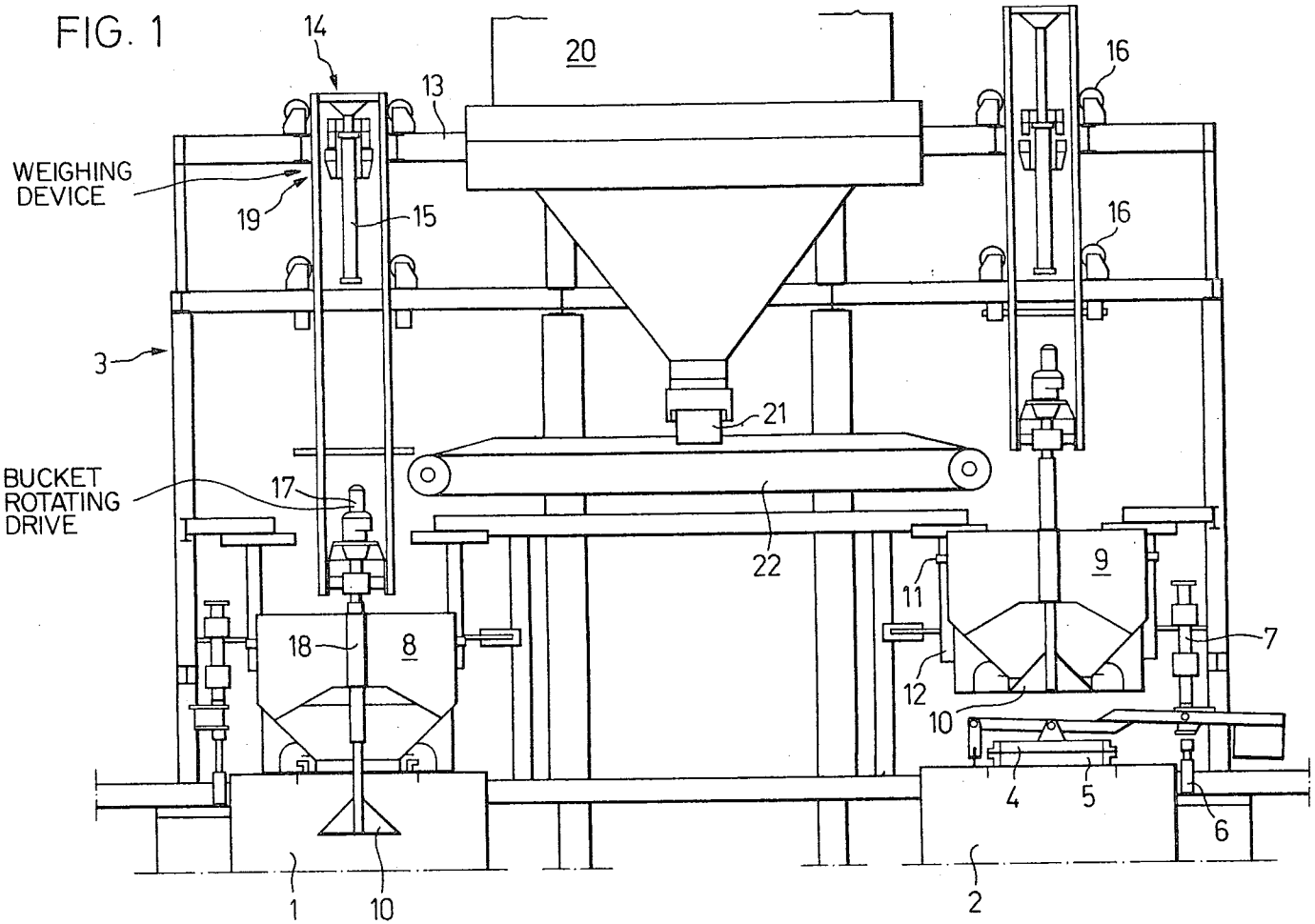
FIG. 1 is a schematic view showing a feed apparatus for a two-shaft furnace in accordance with the present invention.

Referring now to FIG. 1 there is shown in schematic form a furnace wherein the apparatus of the present invention is utilized in delivering raw material to the shafts of the furnace. In FIG. 1, two furnace shafts 1 and 2 are schematically depicted with the upper ends thereof being shown. Above the shafts 1 and 2 there is provided a support scaffolding 3 which may be composed of braces and girders constituting the basic support structure for the apparatus.

Because of the fact that excess pressure may prevail in the shafts 1 and 2, the shaft throat is adapted to be shut off by means of a shutter or gate valve having a cover 4 adapted to be set upon a gate valve seat 5. The shutter valve is opened by being raised by means of a hoist mechanism 6 which may be comprised of a hydro-cylinder, and by being rotated away from the gate valve seat 5 by means of a turning device 7. When the throat is shut, the shutter valve is swung by means of the turning device 7 over the gate valve seat 5 and is then lowered by means of the hoist drive 6 onto the seat 5.

The feed container means of the invention are principally composed of a pair of turning containers or buckets 8 and 9 which are disposed over the shafts 1 and 2. The turning bucket 8 shown in FIG. 1 is represented in the feeding position and the turning bucket 9 is shown in the filling position. The turning buckets 8 and 9 have on the bottoms thereof a bell closure member 10 which may be opened when the turning bucket is lowered onto the throat of the furnace shaft. The guiding of the turning buckets 8 and 9 from the feeding position into the filling position and vice versa occurs by means of guide bearings 11 which are schematically indicated in FIG. 1 and which are fixed on the turning buckets 8 and 9 engaging into guide rails 12.

On the uppermost girder 13 of the support scaffolding 3 there is braced a hanger attachment 14 for each of the turning buckets 8 and 9. The mechanism includes a hoist drive 15 which may be composed of a hydro-cylinder. By operation of the hoist drive 15, the hanger attachment 14 and the turning buckets 8 and 9 hung therefrom may be raised and lowered with the hanger attachment 14 being guided by means of guide rollers 16. At the lower end of the hanger attachment 14 there is supported a geared motor 17. Coupled to the geared motor 17 is an operating rod 18 for the bell closure 10. With the turning bucket raised in the filling position, the rotating action of the buckets 8 and 9 is performed by means of the operating rod 18 and the bell closure 10.

A weighing device 19 which may be composed for example of weight measuring cells, is disposed between the hoist rod 15 and the hanger attachment 14. The weighing device 19 operates to determine the weight of the turning bucket 8, 9 including the fill of material to be calcined which is contained in the bucket.

The apparatus includes a central bin 20 which is adapted for the reception of the material to be calcined, with the bin 20 being disposed above and between the shafts 1 and 2. At the lower end of the bin 20 there is provided a discharge device 21 which may include for example a discharge vibrator, adapted to perform a dosed discharge of the product of combustion. Beneath the discharge device 21 there is provided a reversible conveyor apparatus 22 which may include a conveyor belt the ends of which extend between the turning buckets 8 and 9.

In order to fill either of the turning buckets 8 and 9, the discharge device is put in operation whereby there occurs a conveyance of the raw material to be calcined to the conveyor apparatus 22. From there, the material to be calcined will fall into one of the turning buckets 8 and 9 which lies therebeneath. A uniform distribution of the raw material or limestone pieces of verious size will occur in the turning bucket. The quantity of limestone required for a calcining cycle is distributed to the two turning buckets. Thus the total limestone weight of a combustion cycle of for example eight tons is divided into two quantities of four tons. After each calcining cycle, both the shafts 1 and 2 are filled with the same quantity of stone. This will occur in a simple manner by operation of the apparatus. During the filling process the two shutters are raised and turned aside whereupon the two turning buckets 8 and 9 are set upon the shafts 1, 2 with the bell traps 10 of the turning buckets 8, 9 being lowered. Accordingly, it would also be possible to construct the conveyor device 22 so that the turning buckets of more than two shafts could be filled.

Figure 2:
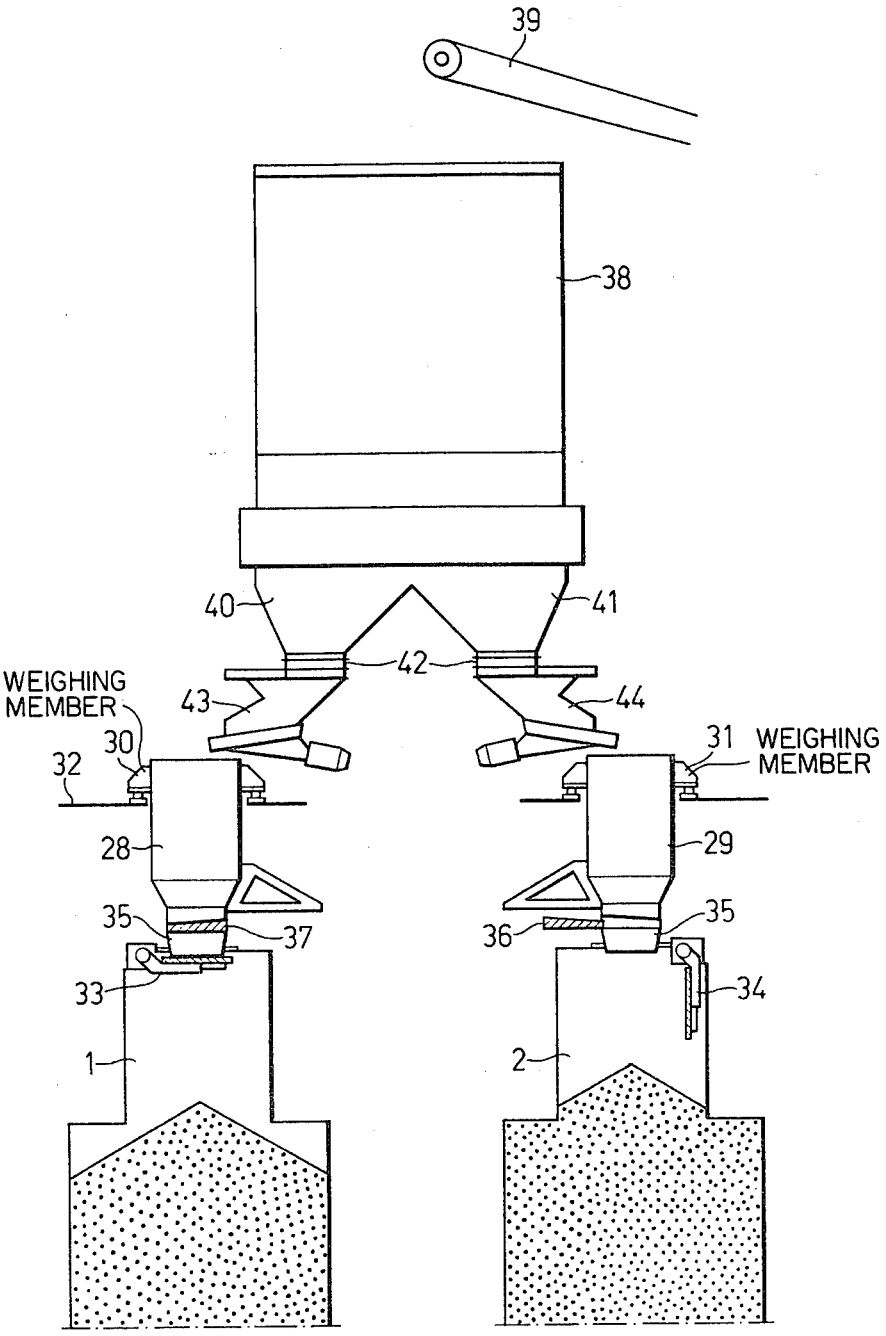
FIG. 2 is a schematic representation showing another embodiment of the apparatus of the invention.

Depicted in FIG. 2 is another feeding apparatus in accordance with the present invention wherein the uniform distribution of the material to be calcined may also be maintained and wherein the necessity for moving great weights over long distances can be avoided. In the apparatus depicted in FIG. 2, the two shafts 1 and 2 of the furnace are arranged to have located thereabove a feeding or weighing container or box 28, 29. The weighing boxes 28, 29 are supported on weighing members 30, 31 which are in turn fixed upon a stationary basis support 32 which is only schematically shown and which is part of the overall support scaffolding not represented in greater detail in FIG. 2.

The shafts 1 and 2 are sealed by a shutter lid 33, 34 which opens into the shaft interior and which in its closed state engages with a lid seat 35 which forms the throat opening of the weighing container 28, 29. Weighing containers 28, 29 have in the lower part thereof a gate valve or shutoff slide valve 36, 37 which is closed during the weighing of a respective charge.

Above the weighing containers 28, 29 there is located a bin 38 for the limestone which is disposed midway relative to the two shafts 1, 2. The limestone bin 38, which is fed by means of a conveyor belt 39 is braced in the support scaffolding of the apparatus which is not shown in detail in FIG. 2. In the base or floor area of the bin 38, two outlet connections 40 and 41 are provided and a discharge vibrator 43, 44 is connected at each mouth 42 of the outlets 40, 41.

The weighing boxes 28, 29 may be fed by the discharge vibrators 43, 44 simultaneously or consecutively. The material conveyed by the vibrators 43, 44 comes directly into the weighing boxes with a uniform distribution of the limestone of different sized pieces being likewise achieved. The quantity of limestone required for the calcining cycle can, as in the embodiment according to FIG. 1, be distributed to the two weighing boxes 28, 29. In order to effect a charging operation, the gate valves 36, 37 and the shaft shutter lids 33, 34 are opened. After the weighing boxes 28, 29 are emptied, these shutoff members or stop valves are closed again. Like the feeding apparatus shown in FIG. 1, the embodiment according to FIG. 2 can also be used for feeding of several furnaces.

While specific embodiments of the invention have been shown and described in detail to illustrate the application of the inventive principles, it will be understood that the invention may be embodied otherwise without departing from such principles.

What is claimed is:

1. In a uniflow regenerative shaft furnace having two shafts for the calcining of limestone and similar raw materials, apparatus for charging said shafts alternately or simultaneously with the raw materials to be calcined comprising:

a pair of rotatable feed containers one located above each of said shafts for charging raw material into said shafts, each of said feed containers having an open top through which said containers may be filled;

conveyor means located to extend laterally between the open tops of said feed containers, said conveyor means being operative to feed raw material in opposite directions to deliver said raw material to the open tops of said feed containers;

valve means for each of said shafts for opening and closing flow of said raw material from said feed containers into said shafts, said valve means including a bell-shaped closure valve for opening and closing the bottoms of said containers;

a bin centrally located above said shafts substantially midway therebetween for delivering said raw material to said conveyor means, said bin including a single discharge device at the bottom thereof through which raw material is delivered onto said conveyor means;

a pair of hanger attachments one supporting each of said feed containers from above for raising and lowering said feed containers between a raised fill position and a lowered feed position;

weighing means in each of said hanger attachments for weighing said containers and the contents thereof; and rotating drive means supported by said hanger attachments for turning said feed containers to maintain said feed containers in rotation during filling thereof with said raw materials.

* * * * *